US007239077B2

(12) United States Patent
Nakamura et al.

(10) Patent No.: US 7,239,077 B2
(45) Date of Patent: Jul. 3, 2007

(54) DISPLAY DEVICE

(75) Inventors: Tomoki Nakamura, Chiba (JP); Yoshiyuki Kaneko, Hachioji (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 433 days.

(21) Appl. No.: 10/858,043

(22) Filed: Jun. 2, 2004

(65) Prior Publication Data

US 2004/0251811 A1 Dec. 16, 2004

(30) Foreign Application Priority Data

Jun. 2, 2003 (JP) ..... 2003-156778

(51) Int. Cl.
*H01J 1/62* (2006.01)
*G09G 3/00* (2006.01)

(52) U.S. Cl. ..... 313/497; 315/169.3

(58) Field of Classification Search ..... None
See application file for complete search history.

(56) References Cited

U.S. PATENT DOCUMENTS 4,614,896 A * 9/1986 Josephs et al. ..... 313/481
5,760,535 A 6/1998 Moyer et al.
6,078,205 A * 6/2000 Ohsawa et al. ..... 327/314
6,580,223 B2 6/2003 Konishi et al.

FOREIGN PATENT DOCUMENTS

| | | |
|---|---|---|
| JP | 10-134701 | 5/1998 |
| JP | 10-255692 | 9/1998 |
| JP | 2000-306508 | 11/2000 |
| JP | 2003-0012154 | 2/2003 |

* cited by examiner

*Primary Examiner*—Ashok Patel
(74) *Attorney, Agent, or Firm*—Antonelli, Terry, Stout & Kraus, LLP.

(57) ABSTRACT

For absorbing a high voltage when an abnormal discharge is generated between an anode and another electrode, between an anode ADE and a control electrode G1, a surge current absorbing electrode G2 which has a plurality of electron beam passing holes AHL which allow electron beams to pass therethrough is arranged, and a DC bias power source DCG and a spark gap SG are connected in parallel between the surge current absorbing electrode G2 and a ground surface.

6 Claims, 4 Drawing Sheets

DISPLAY DEVICE

BACKGROUND OF THE INVENTION

The present invention relates to an image display device which utilizes emission of electrons into vacuum, and more particularly to the electrode structure which protects a drive circuit system.

Recently, as an image display device which exhibits high brightness and high definition, a color cathode ray tube has been popularly used. However, along with the recent efforts for achieving high image quality in information processing equipment and television broadcasting, a demand for a planar display (panel display) which is lightweight and space-saving while having favorable characteristics such as high brightness and high definition is increasing.

As a representative example, a liquid crystal display device, a plasma display device and the like have been commercially available. Further, with respect to the image display device which aims at high brightness particularly, various types of panel-type display devices such as a display device which makes use of emission of electron in vacuum from electron sources (hereinafter referred to as an electron emission type display device or a field emission type display device, hereinafter abbreviated as FED) and an organic EL display device which features low power consumption.

FIG. 6 is an enlarged cross-sectional view of the vicinity of one pixel for schematically explaining the basic structure of the FED. In FIG. 6, the FED includes a back substrate SUB1 which forms cathode lines CL which include cathodes K as field-emission-type electron sources and a control electrode G1 on an inner surface thereof and a face substrate SUB2 which forms an anode ADE, phosphors PHS and a black matrix BM on an inner surface thereof which faces the back substrate SUB1 in an opposed manner, wherein the FED is constituted by laminating both substrates SUB1, SUB2 by inserting a sealing frame between inner peripheries of both substrates SUB1, SUB2 and by creasing vacuum in the inside of the laminated structure.

Further, there has been also known the structure which provides insulating space holding members ISP between the back substrate SUB1 and the face substrate SUB2 to hold a distance of given size between the back substrate SUB1 and the fade substrate SUB2. Here, with respect to these types of prior art, for example, following Patent Document 1 and Patent Document 2 can be named.

[Patent Document 1]

Japanese Unexamined Patent Publication Hei 10-134701

[Patent Document 2]

Japanese Unexamined Patent Publication 2000-306508

In the FED having such a constitution, the control electrode G1 which has electron passing holes EHL is provided between the cathodes K which are formed on the cathode line CL on the back substrate SUB1 and the anode ADE which is formed on the face substrate SUB2, wherein by imparting the given potential difference to the control electrode G1 with respect to the cathode line G1, electrons E are pulled out from the cathodes K and the electrons E are made to pass through the electron passing holes EHL and are made to impinge on the phosphors at the anode ADE side thus performing an image display.

SUMMARY OF THE INVENTION

However, the FED having such a constitution is configured to define a space size of approximately several mm between opposing surfaces of the anode ADE and the cathode line CL and, to make the phosphors PHS efficiently emit light, a high voltage of approximately 5 kV to 30 kV is applied to the anode ADE, a voltage of approximately 1 kV or less is applied to the control electrode G1, and a voltage of several hundreds V is applied to the cathodes K. Due to such a constitution, in the FED, the anode voltage is relatively high compared to other various electrode voltages and hence, there has always existed a possibility that an abnormal discharge is generated between the anode ADE and other electrode with some probability.

Further, in the FED having the electrode structure shown in FIG. 6, the abnormal discharge is generated either between the anode ADE and the control electrode G1 or between the anode ADE and the cathodes K and hence, the potentials of the control electrode G1 and the anodes K are elevated to a level substantially equal to the potential of the anode ADE. As a result, the anode potential is applied to respective drive circuits of the control electrode G1 and the cathodes K. Since rated voltages of the respective drive circuits of the control electrode G1 and the cathodes K is approximately several hundreds v at a maximum, unless the dielectric strength characteristics take the safety factor into consideration with respect to the anode voltage, the respective drive circuits are broken when the abnormal discharge is generated.

Since the control electrode G1 and the cathodes K are usually driven by matrix driving in the FED to overcome such a drawback, in each drive circuit, it is necessary to take countermeasure to prevent the abnormal discharge for every-row line and every-column line. Accordingly, it is necessary to provide elements of each drive circuit in number which corresponds to the number of lines and hence, this becomes a factor for pushing up a cost of parts. Further, with respect to the drive circuit having the sufficient dielectric strength characteristics, since the dielectric strength characteristics are abnormally high with respect to a rated voltage, the cost of the drive circuit elements per se becomes substantially equal to the cost of elements for high drive voltage thus also pushing up the cost. Here, conventionally, there has been found no countermeasures which are provided for preventing the generation of the abnormal discharge from this point of view.

Accordingly, the present invention has been made to solve the above-mentioned conventional drawbacks and it is an object of the present invention to provide an image display device which can absorb a high voltage when an abnormal discharge is generated between an anode and respective other electrodes and hence, a dielectric strength of each drive circuit can be suppressed low whereby a cost of drive circuit elements can be reduced. Further, it is another object of the present invention to provide an image display device which can enhance the quality and the reliability by suppressing the generation of the abnormal discharge.

To achieve the above-mentioned objects, in the image display device of the present invention, by arranging a surge current absorbing electrode having apertures which allow electrons to pass therethrough between opposing surfaces of the anode and the control electrode, the high voltage at the time of generation of the abnormal discharge can be absorbed.

In the above-mentioned constitution of the present invention, it is desirable that the surge current absorbing electrode is formed of a plate-like electrode which has a plurality of electron beam passing holes which allow electrons to pass therethrough at regions which correspond to the electron passing holes formed in the control electrode and, at the same time, a DC bias power source and a spark gap are connected in parallel between the plate-like electrode and a ground surface whereby the high voltage at the time of generation of the abnormal discharge can be absorbed.

Further, it is desirable that the surge current absorbing electrode is formed of a plate-like electrode which has a plurality of electron beam passing holes which allow electrons to pass therethrough at regions which correspond to the electron passing holes formed in the control electrode and, at the same time, a DC bias power source and a Zener diode are connected in parallel between the plate-like electrode and a ground surface whereby the high voltage at the time of generation of the abnormal discharge can be absorbed.

Here, it is needless to say that the present invention is not limited to the above-mentioned constitution and the constitutions of respective embodiments described later and various modifications can be made without departing from the technical concept of the present invention.

DESCRIPTION OF THE PREFERRED EMBODIMENTS

Preferred embodiments of the present invention are explained in detail in conjunction with drawings which show embodiments.

Figure 1:
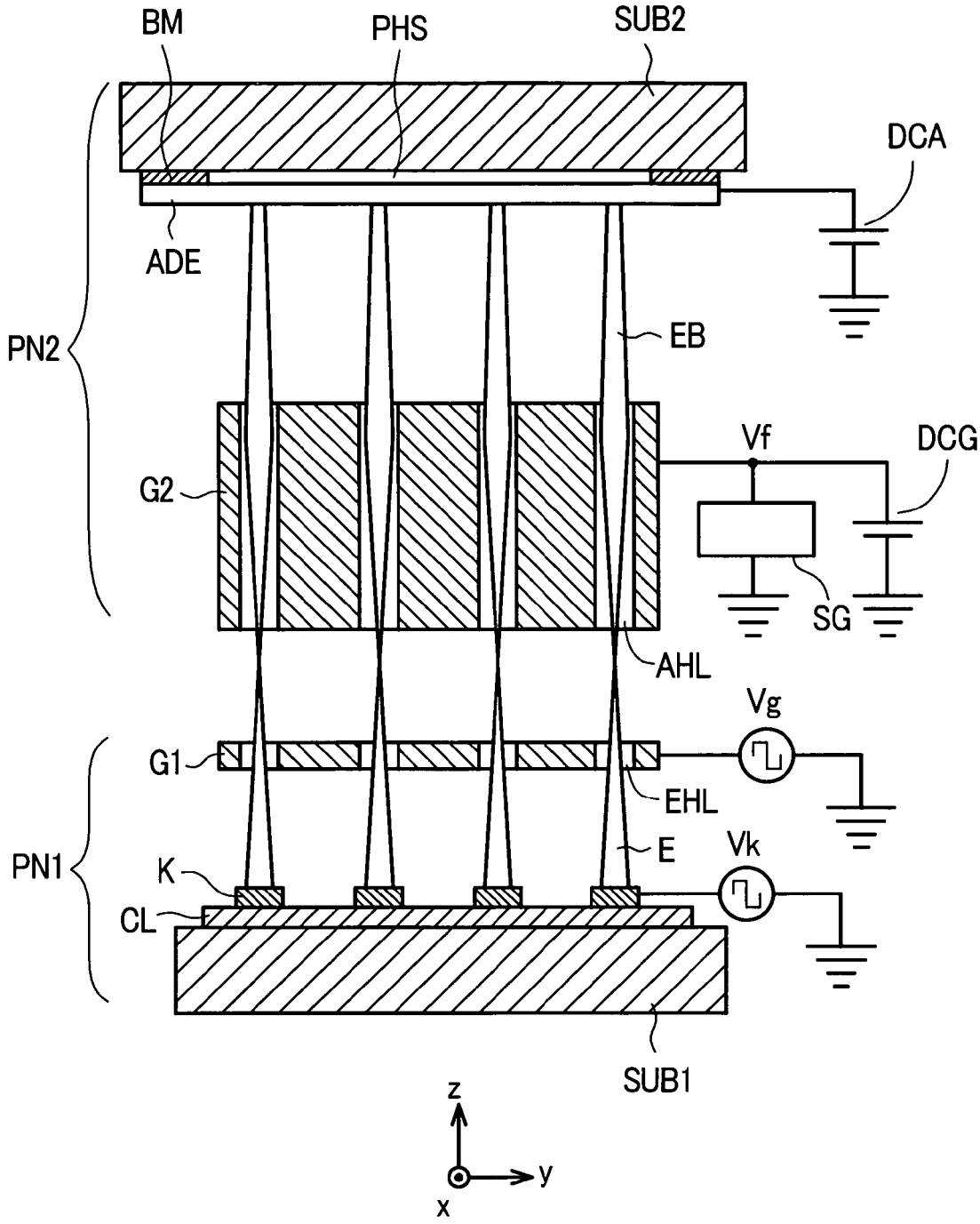
FIG. 1 is an enlarged cross-sectional view of the vicinity of one pixel which schematically explains one embodiment of an image display device according to the present invention.

FIG. 1 is an enlarged cross-sectional view of the vicinity of one pixel which schematically explains one embodiment of the image display device according to the present invention. In FIG. 1, reference symbol SUB1 indicates a back substrate which is formed of an insulating substrate preferably made of as a glass or the like and constitutes a back panel PN1. On an inner surface of the back substrate SUB1, a plurality of cathode lines CL which extend in one direction y (here, the vertical direction) and are arranged in parallel in another direction x (here, the horizontal direction) and have cathodes K as electron generated sources are formed on an inner surface of the back substrate SUB1.

Further, above the back panel PN1, control electrodes G1 are arranged to face the back panel PN1 in a non-contact state. The control electrodes G1 cross the cathode lines CL in a non-contact state and extend in the x direction, are arranged in parallel in the y direction, and form pixels at portions thereof which cross cathode lines CL. Further, the control electrodes G1 have a plurality of electron passing apertures EHL in the pixels which allow electrons E emitted from the cathodes K to pass therethrough toward the face panel PN2 side.

Further, above the control electrodes G1, a surge current absorbing electrode G2 which has electron beam passing holes AHL for allowing the respective electron beams EB to pass therethrough in regions which face the respective electron passing apertures EHL formed in the control electrodes G1 is arranged to face an anode ADE in a non-contact state. Further, to the surge current absorbing electrode G2, a spark gap SG which is formed with an electrode gap of several μm to several tens μm between the spark gap SG and a ground surface is connected.

Here, the surge current absorbing electrode G2 is, for example, mounted on and fixed to an inner surface side of the face substrate SUB2 using a holding member not shown in the drawing and the spark gap SG is configured to be mounted on and fixed to the inner surface side of the back substrate SUB1.

Here, the cathode line CL is, for example, formed by patterning a conductive paste including silver or the like by printing and, thereafter, by baking the patterned paste. Further, to form the cathodes K which are arranged above (the face substrate SUB2 side) the crossing portions of the cathode lines CL with the control electrodes G1, for example, carbon nanotubes (CNT) are used. As one example, the cathodes K are formed by patterning a paste including silver, boron, carbon nanotubes (Ag—B—CNT paste) by printing and by baking the printed paste.

Further, the control electrodes G1 and the surge current absorbing electrode G2 are formed by forming a large number of circular electron passing apertures EHL and a large number of circular electron beam passing holes AHL in thin plates formed of a conductive metal plate material made of, for example, nickel, by a etching process using a photolithography method.

On the other hand, in the z direction with respect to the back panel PN1, the face panel PN2 is laminated to the back panel PN1 in the vertical direction with a given gap therebetween using a frame body not shown in the drawing. The face panel PN2 is constituted such that phosphors PHS which are divided by a black matrix BM and an anode ADE are formed in an inner surface of the face substrate SUB2 which is formed of a light transmitting insulation substrate such as a glass plate or the like. Further, on the surface of the front substrate SUB2 which faces the anode ADE, the surge current absorbing electrode G2 having the electron beam passing holes AHL which allow the electron beams EB to pass therethrough is arranged in a non-contact state, wherein a gap between the back panel PN1 and the face panel PN2 is held at a given gap and the inside thereof is sealed to create a vacuum therein.

In the FED having such a constitution, a DC power source DCA which applies a high voltage of approximately 5 to 30 kV is connected to the anode ADE and a DC bias power source DCG which applies a current bias voltage Vf of approximately 1 kV is connected to the surge current absorbing electrode G2. In this case, the DC bias power source DCG is configured to be connected in parallel with the spark gap SG with respect to the ground surface. Further, to the cathodes K and the control electrodes G1, although not shown in the drawing, pulse voltages Vk, Vg of approximately several 100 V which perform matrix driving from respective driving circuits are supplied in response to respective driving timings.

Here, assuming a rated amplitude voltage as Vs, dielectric strengths of respective driving circuits as Vmax, a DC bias voltage of the surge current absorbing electrode G2 as Vf, a dielectric strength of a spark gap SG (the charging start voltage) as Vo, the dielectric strength of the spark gap SG is acceptable when the relationship that Vs, Vf, Vmax are Vs, Vf<Vo<Vmax is satisfied.

In such a constitution, an abnormal discharge is generated between the anode ADE and the surge current absorbing electrode G2. Here, although the voltage of the surge current absorbing electrode G2 increases from the initially set DC bias voltage Vf, when the potential of the surge current absorbing electrode G2 exceeds the dielectric strength Vo of the spark gap SG, the surge current flows and the spark gap SG is short-circuited with the ground surface and is absorbed and hence, the potential of the surge current absorbing electrode G2 hardly becomes higher than Vo.

As a result, the discharge is hardly generated between the surge current absorbing electrode G2 and the control electrode G1 and the cathode K and hence, the dielectric strength of respective driving circuits of the control electrode G1 and the cathode K can be set at a low level. Further, since Vo is set such that Vo<Vmax, even when a discharge is generated between the surge current absorbing electrode G2 and the control electrode G1 and the cathode K by any chance, respective driving circuits are hardly damaged.

Figure 2:
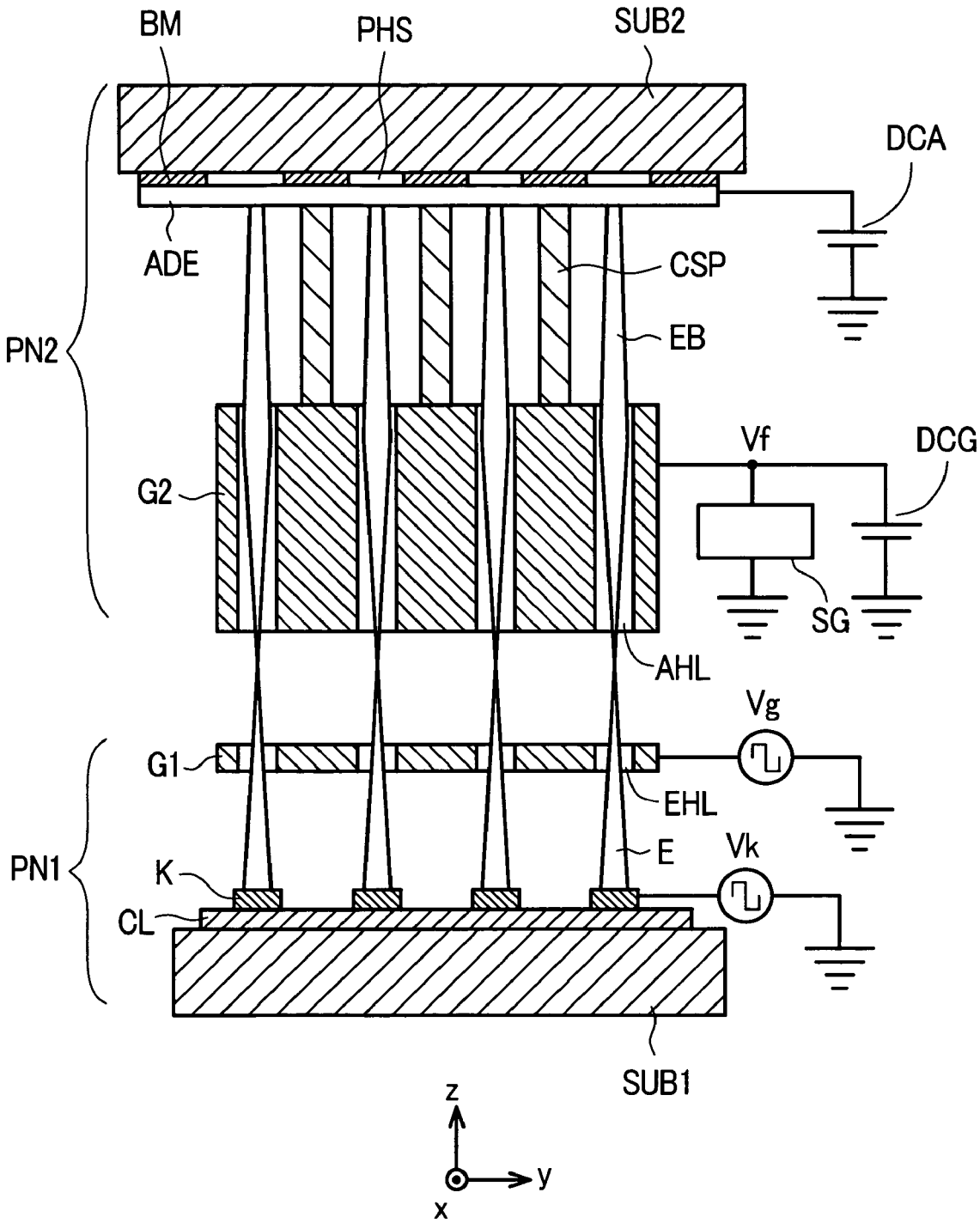
FIG. 2 is an enlarged cross-sectional view of the vicinity of one pixel which schematically explains another embodiment of an image display device according to the present invention.

FIG. 2 is an enlarged cross-sectional view of the vicinity of one pixel which schematically explains another embodiment of the image display device according to the present invention. In FIG. 2, the same symbols are given to parts identical with the parts shown in FIG. 1 and the explanation thereof is omitted. The constitution which makes the embodiment shown in FIG. 2 different from the embodiment shown in FIG. 1 lies in that a plurality of conductive spacers CSP are mounted in the regions which do not interrupt the irradiation paths of electron beams EB between the anode. ADE and the surge current absorbing electrode G2 which are formed on an inner surface side of the face substrate SUB2 and the respective conductive spacers CSP are electrically connected. In this case, it is necessary to impart a proper resistance value to these conductive spacers CSP to prevent the generation of a surface discharge and to form the inclination of an electric field between facing surfaces of the anode ADE and the surge current absorbing electrode G2.

In such a constitution, when FED is made large-sized, to hold a gap between the cathodes K and the anode ADE, it is necessary to provide insulating spacers as gap holding members. To stabilize the face potential of these insulating spacers and to minimize the influence of the face potential to the electron beams EB, it is effective to use conductive spacers CSP. In this case, although the current flows in the conductive spacers CSP, by connecting low potential side to the constant voltage surge current absorbing electrode G2, the flow of the spacer current to respective driving circuits can be prevented. Accordingly, it is no more necessary to increase the rated current of the respective driving circuits.

Figure 3:
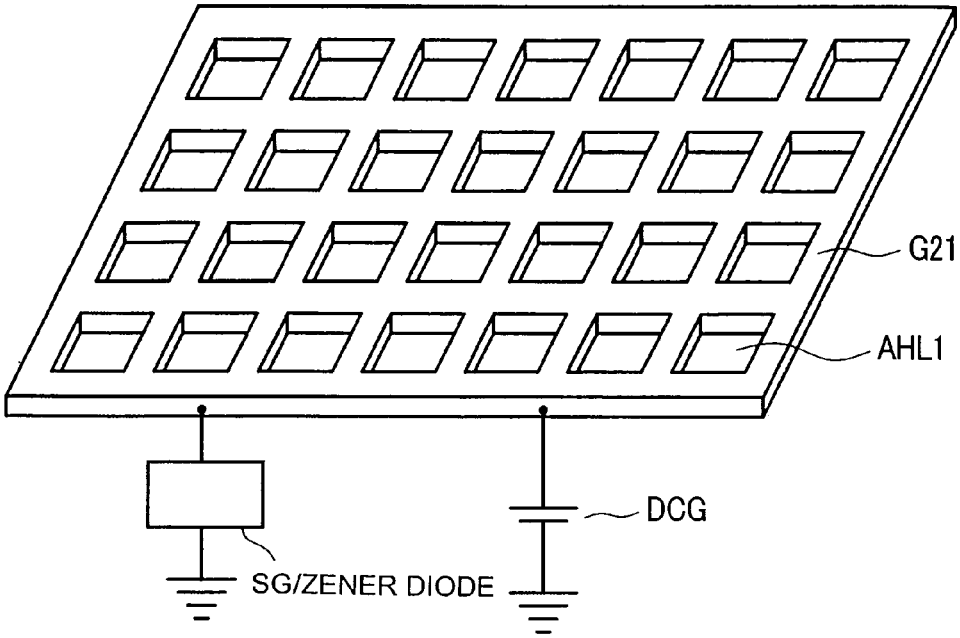
FIG. 3 is a perspective view which explains the constitution of another embodiment of a surge current absorbing electrode of an image display device according to the present invention.

FIG. 3 is a perspective view showing the constitution according to another embodiment of the surge current absorbing electrode with respect to the image display device according to the present invention. The constitution which makes the embodiment shown in FIG. 3 different from the embodiment shown in FIG. 1 lies in that, in surge current absorbing electrodes G21, electron beam passing holes AHL1 which allow electron beams to pass therethrough collectively for every pixel are formed in an arranged manner in number equal to the number of pixels. Further, in this embodiment, a spark gap SG or Zener diode, as illustrated, and a DC bias power source DCG are configured to be connected in parallel between the surge current absorbing electrode G21 and the ground surface.

Figure 4:
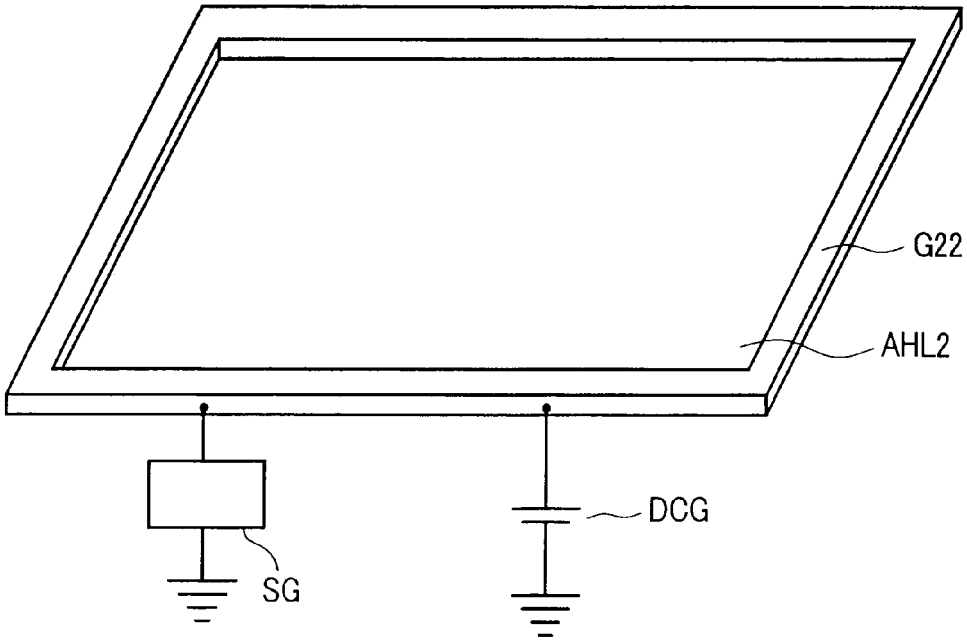
FIG. 4 is a perspective view which explains the constitution of another embodiment of a surge current absorbing electrode of an image display device according to the present invention.

FIG. 4 is a perspective view showing the constitution according to still another embodiment of the surge current absorbing electrode with respect to the image display device according to the present invention. The constitution which makes the embodiment shown in FIG. 4 different from the embodiment shown in FIG. 1 lies in that, in the surge current absorbing electrode G22, a single electron beam passing hole AHL2 which allows all of a group of electron beams to pass through the inside of the display region is formed. Further, a spark gap SG and a DC bias power DCG are configured to be connected in parallel between the surge current absorbing electrode G22 and the ground surface.

Figure 5:
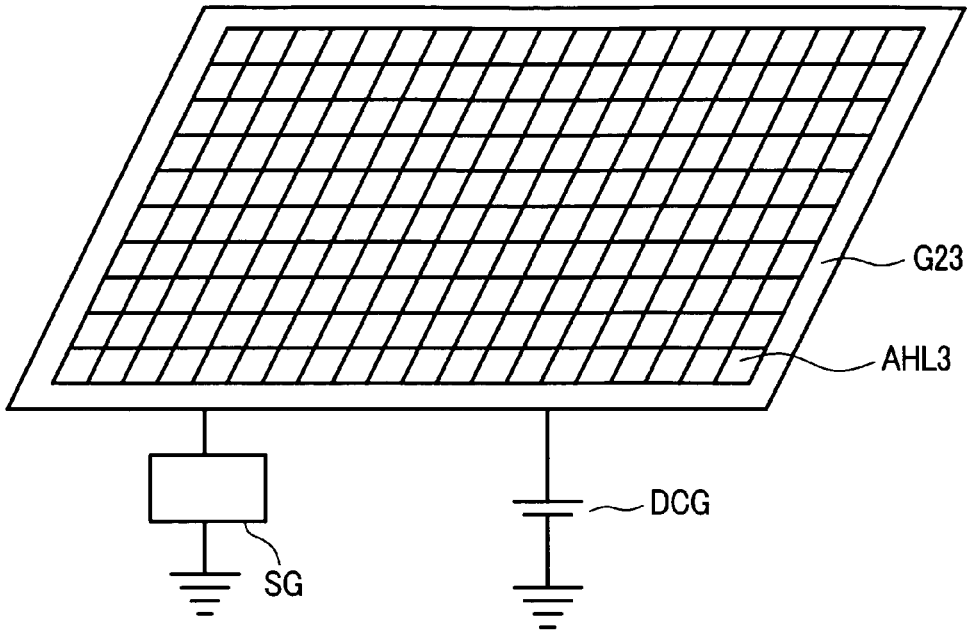
FIG. 5 is a perspective view which explains the constitution of another embodiment of a surge current absorbing electrode of an image display device according to the present invention.
Figure 6:
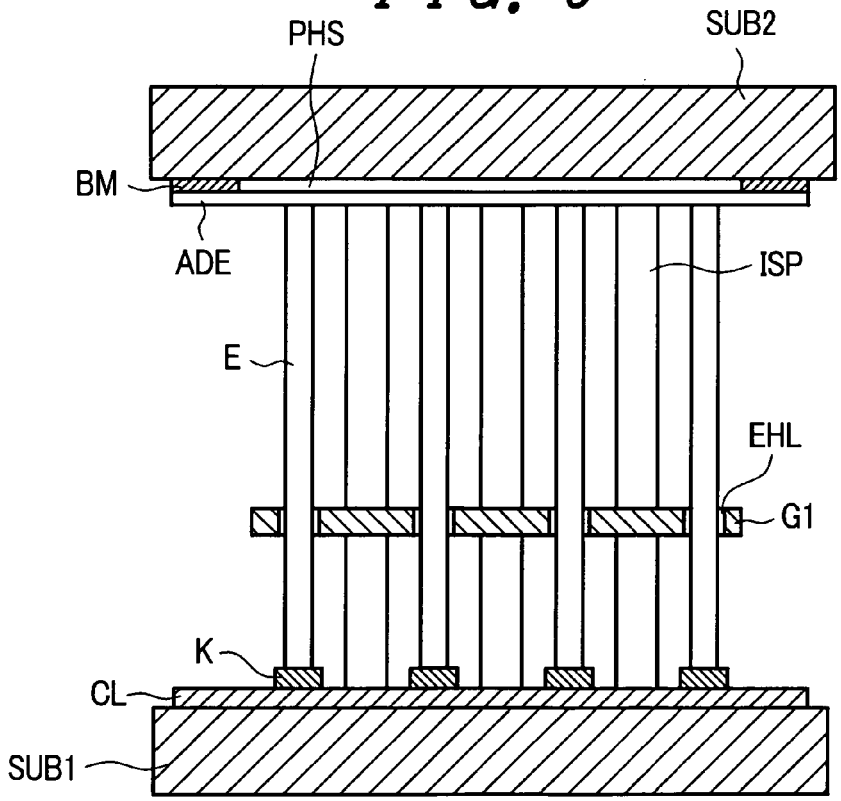
FIG. 6 is an enlarged cross-sectional view of the vicinity of one pixel which schematically explains the basic structure of a field emission type image display device.

FIG. 5 is a perspective view showing the constitution according to still another embodiment of the surge current absorbing electrode with respect to the image display device according to the present invention. The constitution which makes the embodiment shown in FIG. 5 different from the embodiment shown in FIG. 1 lies in that, in the surge current absorbing electrode G23, mesh-like electron beam passing holes AHL3 which allow the electron beams to pass therethrough are collectively formed for every pixel in an arranged manner and in number equal to the number of pixels. Further, a spark gap SG and a DC bias power source DCG are connected in parallel between the surge current absorbing electrode G23 and the ground surface.

Here, in these surge current absorbing electrodes G21, G22, G23, the electron beam passing holes AHL1, AHL3 and the electron beam passing holes AHL2 are formed in a conductive thin plate material such as a nickel plate or the like, for example, by etching using a photolithography method or press forming.

Also with the use of these constitutions, when an abnormal discharge is generated between the anode and the cathode and the control electrode, a high voltage can be absorbed by each one of the surge current absorbing electrodes G21, G22, G23 to which the DC bias power DCG is connected and hence, the risk that the high voltage is applied to each driving circuit can be eliminated.

Here, the above-mentioned surge current absorbing electrodes G21, G22, G23 may be also used as focusing electrodes of electron beams. Further, the respective surge current absorbing electrodes G21, G22, G23 may be constituted such that the potentials thereof are set to be operated as accelerating electrodes with respect to the cathode K, the control electrode G1 and the emission of electrons from the cathodes K may be conducted by the triode operation.

Here, although, in the above-mentioned respective embodiments, the explanation has been made with respect to the case in which the spark gap SG is used as the discharge electrode between respective surge current absorbing electrodes G21, G22, G23 and the ground surface, the present invention is not limited to such a constitution and, even when a Zener diode having a Zener voltage which exceeds a current bias voltage Vf is used in each of the embodiment instead of the spark gap SG, as shown in FIG. 3, for example, the exactly same advantageous effects as described above can be obtained.

Here, although, in the above-mentioned respective embodiments, the explanation has been made with respect to the case in which the present invention is applied to the field emission display (FED) using carbon nanotubes (CNT) as the electron sources as the image display device, it is needless to say that the present invention is not limited to such an application and even when the present invention is applied to a field emission panel display using other electron source structure, the exactly same advantageous effects as mentioned above can be obtained.

As explained heretofore, according to the image display device of the present invention, when the abnormal discharge is generated between the anode and each electrode, by making the surge current absorbing electrode absorb the high voltage, the risk that the high voltage is applied to each driving circuit can be eliminated and hence, the dielectric strength of driving circuits can be suppressed at a low level whereby the cost of the driving circuit elements can be suppressed. Further, since it is no more necessary to use the driving circuit elements having high dielectric strength characteristics, the cost of the set can be reduced and, at the same time, the generation of the abnormal discharge can be prevented whereby the extremely excellent advantageous effects including the enhancement of quality and reliability can be obtained.

What is claimed is:

1. An image display device comprising:

a face substrate having an anode and phosphors on an inner surface thereof;

a back substrate having first electrode lines which extend in one direction and are arranged in parallel in another direction which intersects one direction, and second electrode lines which are arranged in a non-contact manner with the first electrode lines, extend in another direction and are arranged in parallel in one direction on an inner surface thereof, the back substrate being arranged to face the face substrate in an opposed manner with a given distance therebetween;

a sealing frame body which is inserted between the face substrate and the back substrate in a state the sealing frame body surrounds a display region and holds the given distance;

wherein electron beams are pulled out by imparting the potential difference between the first electrode lines and the second electrode lines and the electron beams are allowed to impinge on the phosphors of the face substrate thus performing an image display;

wherein the image display device includes a surge current absorbing electrode which is arranged between the face substrate and the back substrate and has apertures which allow the electron beams to pass therethrough;

wherein a DC bias power source and a high voltage absorbing means are connected in parallel between the surge current absorbing electrode and a ground surface; and wherein a conductive spacer is interposed between the anode and the surge current absorbing electrode.

2. An image display device according to claim 1, wherein the high voltage absorbing means is a spark gap.

3. An image display device according to claim 1, wherein the high voltage absorbing means is a Zener diode.

4. An image display device according to claim 1, wherein the surge current absorbing electrode is formed of a plate-like electrode having a plurality of electron beam passing holes.

5. An image display device according to claim 1, wherein the surge current absorbing electrode is formed of a mesh-like electrode having a plurality of electron beam passing holes.

6. An image display device according to claim 1, wherein the surge current absorbing electrode is formed of a plate-like electrode having a single electron beam passing hole.

* * * * *